US011150043B1

(12) United States Patent
Liu

(10) Patent No.: US 11,150,043 B1
(45) Date of Patent: Oct. 19, 2021

(54) BULLET ALIGNING DEVICE

(71) Applicant: Cheh-Kang Liu, Taipei (TW)

(72) Inventor: Cheh-Kang Liu, Taipei (TW)

( * ) Notice: Subject to any disclaimer, the term of this patent is extended or adjusted under 35 U.S.C. 154(b) by 0 days.

(21) Appl. No.: 17/124,665

(22) Filed: Dec. 17, 2020

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/02
See application file for complete search history.

(56) References Cited

U.S. PATENT DOCUMENTS 10,533,817 B1 * 1/2020 Hefer ..... F41A 9/83
2016/0305726 A1 * 10/2016 Mokuolu ..... F41A 9/83
2019/0226780 A1 * 7/2019 Slevin ..... F41A 9/83
2020/0049438 A1 * 2/2020 Hatch ..... F41A 9/83

* cited by examiner

*Primary Examiner* — J. Woodrow Eldred
(74) *Attorney, Agent, or Firm* — Demian K. Jackson; Jackson IPG PLLC

(57) ABSTRACT

A bullet aligning device in which the bullet on the turntable can be thrown to the periphery of the turntable through centrifugal force and sent out through the bullet outlet, and the adjacent wall of the bullet outlet is provided with a through groove, the height of the through groove is slightly smaller than the diameter of the bullet to prevent two or more bullets from jamming the bullet outlet to ensure the smooth delivery of bullets. The bullet aligning device uses the directional track arrangement to allow only one bullet to enter the guide groove at a time to give each bullet enough time and space to fall, so that the bullets choose the heavier tail to fall into the direction-correcting guide slot, and the bullets in the same direction are exported from the one-way export slot.

2 Claims, 7 Drawing Sheets

BULLET ALIGNING DEVICE

BACKGROUND AND SUMMARY OF THE INVENTION

The present invention relates to a bullet aligning device that uses the gravity of the bullet to export bullets in the same direction without getting stuck.

Filling the bullet into the magazine may easily cause sore hands or inconvenience. Therefore, the electronic magazine loader has been published on the market. When it wants to fill the bullet into the magazine, it must arrange the bullets in the same direction through the aligning device and then enter the filling action. However, during the process of the bullet passing through the aligning device, due to the fact that the bullet is overfilled or blocked, there is still the possibility of alignment error (incorrect direction) or jamming. When an alignment error or jamming problem occurs, it is necessary to disassemble the electronic magazine loader for maintenance, which will cause user's troubles. In addition, this electronic magazine loader also needs to pre-set to the number of bullets to be loaded into the magazine before it can be activated, so the use is also limited.

The present invention has been accomplished under the circumstances in view. It is therefore the main object of the present invention to provide a bullet aligning device that uses the directional track arrangement to allow only one bullet to enter the guide groove at a time to give each bullet enough time and space to fall, so that the bullets choose the heavier tail to fall into the direction-correcting guide slot, and the bullets in the same direction are exported from the one-way export slot to facilitate the filling of bullets into the magazine with the bullet filling device or the electronic magazine loader.

It is another object of the present invention to provide a bullet aligning device, which has a through groove formed on the circumferential wall of the turntable holder thereof adjacent to one end of the bullet outlet, and the height of the through groove is smaller than the diameter of the bullet to prevent the heads of two or more bullets from jamming the bullet outlet, thereby ensuring that the bullets are arranged in the wide direction (short side) and sent out the turntable holder smoothly, which relatively avoids the trouble of manpower to eliminate the jamming operation.

DETAILED DESCRIPTION OF THE INVENTION

Figure 1:
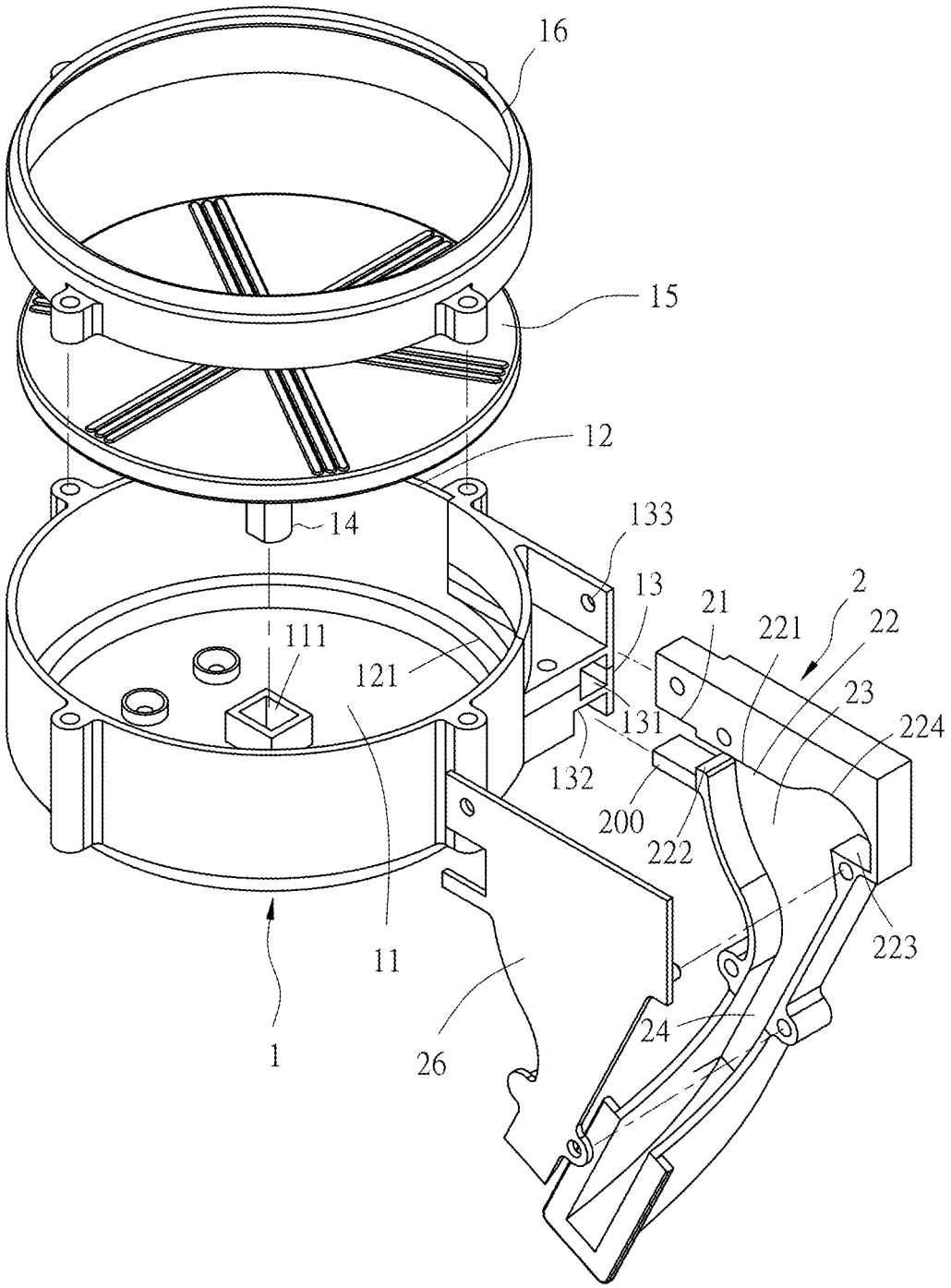
FIG. 1 is an exploded view of a bullet aligning device in accordance with the present invention.

Referring to FIGS. 1-7, a bullet aligning device in accordance with the present invention, comprising a turntable holder 1 and an track 2.

The turntable holder 1 comprises a bottom wall 11, a circumferential wall 12 connected above the bottom wall 11, a connecting portion 13 externally connected to the circumferential wall 12, and a mounting groove 111 located on the bottom wall 11 for setting a motor 14 to directly or indirectly drive a turntable 15 to rotate. The bottom wall 11 can be additionally equipped with a battery pack (not shown) to provide power to the motor 14, or an indoor power source can be used to provide power to the motor 14, as it is a conventional technology to provide power to the motor 14, so I will not repeat it. The aforementioned circumferential wall 12 has a bullet outlet 121, and the connecting portion 13 has a linear guide channel 131, and the bullet outlet 121 is in communication with the linear guide channel 131. The aforementioned circumferential wall 12 further has a through groove 122 communicating with one end the bullet outlet 121 (refer to FIG. 7). The highest height H1 of the through groove 122 is slightly smaller than the diameter D of a bullet 3 to be aligned (refer to FIG. 5). When the turntable 15 rotates, the bullets 3 poured into the turntable 15 are thrown to the periphery of the turntable 15 through centrifugal force, and enter the linear guide channel 131 of the connecting portion 13 through the bullet outlet 121 of the circumferential wall 12. Since one end of the bullet outlet 121 is in communication with the through groove 122, it can prevent two or more bullets 3 from getting stuck in the bullet outlet 121, ensuring that the bullets 3 can be sent out smoothly through the bullet outlet 121. In addition, the connecting portion 13 is provided with a plug hole 132, and at least a connecting hole 133 is also provided. Further, an upper fence 16 is fastened to the top side of the circumferential wall 12 with first fastening members 17 (see FIG. 2).

Figure 2:
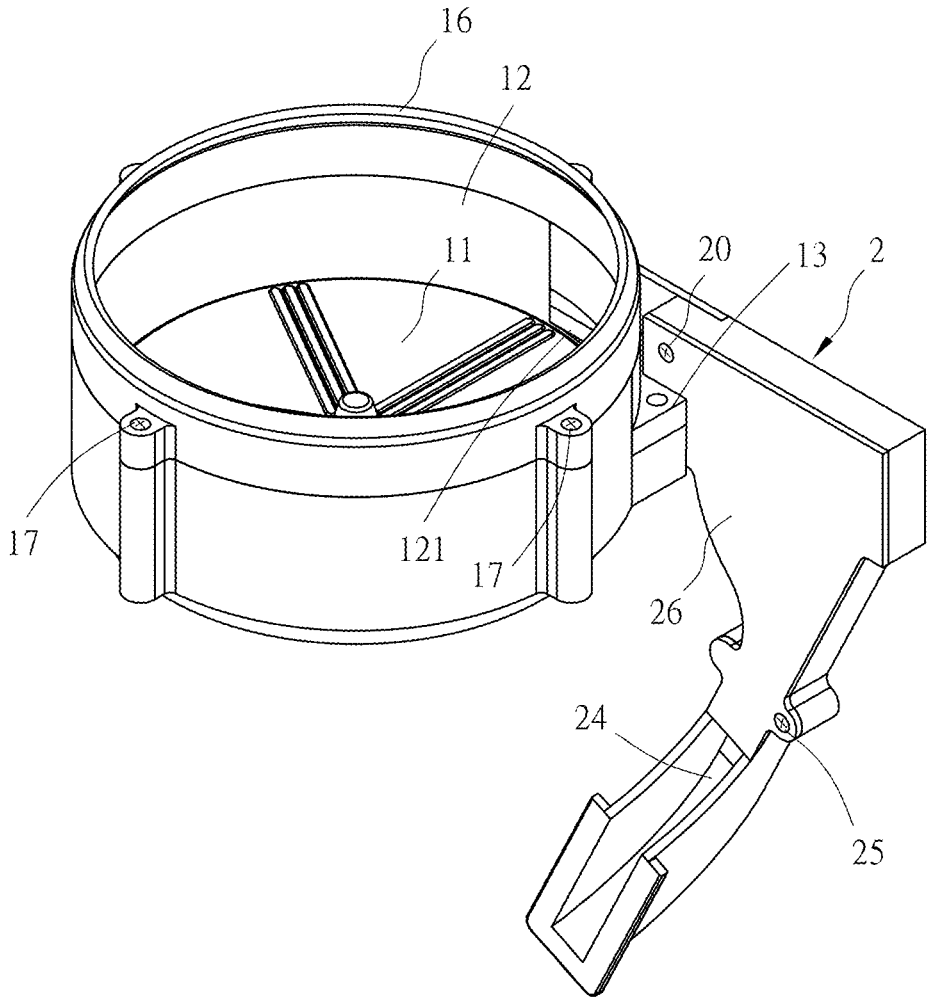
FIG. 2 is a top elevational view of the bullet aligning device in accordance with the present invention.
Figure 3:
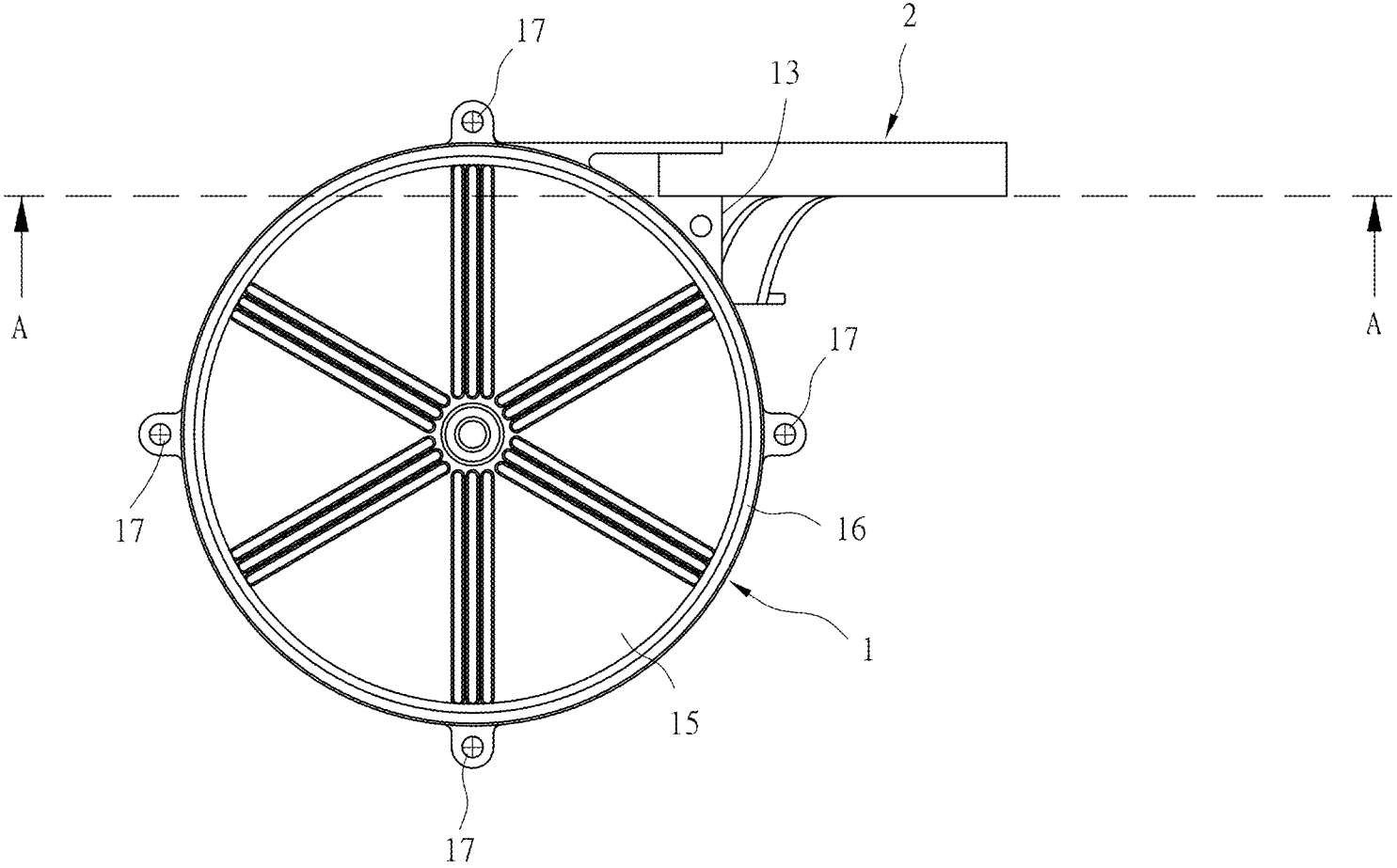
FIG. 3 is a top plain view of the bullet aligning device in accordance with the present invention.

The track 2 has an insert block 200 located at one side thereof and plugged into the plug hole 132 of the turntable holder 1, and is connected to the side of the circumferential wall 12 of the turntable holder 1 through at least one second fastening member 20 (refer to FIG. 2). The track 2 also comprises an entrance 21 (refer to FIG. 4), a direction-correcting upper slot 22 (refer to FIG. 4), a direction-correcting guide slot 23 and a one-way export slot 24. The entrance 21 has one end thereof connected to the end of the linear guide channel 131 of the connecting portion 13 of the turntable holder 1, and an opposite end thereof connected to the direction-correcting upper slot 22. The direction-correcting upper slot 22 has an upper side thereof disposed adjacent to an upper wall 221, and front and rear ends of an opposing lower side thereof respectively disposed adjacent to a first lower wall 222 and a second lower wall 223. The width distance W1 between the first lower wall 222 and the second lower wall 223 (refer to FIG. 4) is less than the length L of the bullet case of the bullet 3 (refer to FIG. 5). The height distance H2 between the first lower wall 222 and the upper wall 221 is slightly larger than the diameter D of the bullet 3 and is only for the bullet 3 to pass transversely. The lower side of the direction-correcting upper slot 22 communicates with an upper side of the direction-correcting guide slot 23. The direction-correcting guide slot 23 is narrowed from the upper side to the lower side thereof and then connected to the upper end of the aforementioned one-way export slot 24. The slot width W2 of the one-way export slot 24 (refer to FIG. 4) is slightly larger than the diameter D of the bullet 3 to restrict the bullet 3 to only one-way export from the one-way export slot 24. The track 2 is also connected with a track cover 26 (see FIG. 2) through third fastening members 25 (refer to FIG. 2) or by other means, and the track cover 26 can also be integrally formed with the track 2.

Therefore, when the turntable 15 is driven and rotated by the motor 14, the bullets 3 poured into the turntable 15 can be thrown to the periphery of the turntable 15 by centrifugal force and sent out by the bullet outlet 121 of the circumferential wall 12 and guided by the linear guide channel 131 to enter the direction-correcting upper slot 22 via the entrance 21 of the track 2. When the tail 32 of the bullet 3 first passes through the first lower wall 222 adjacent to the direction-correcting upper slot 22 (refer to FIG. 5), the heavier gravity action of the bullet 3 tail 32 causes the bullet 3 tail 32 to fall into the direction-correcting guide slot 23 and then be guided out along the one-way export slot 24. When the bullet head 31 of bullet 3 first passes through the first lower wall 222 adjacent to the direction-correcting upper slot 22, the bullet 3 is supported by the first lower wall 222 and will not immediately fall down into the direction-correcting guide slot 23. When the bullet head 31 of this bullet 3 enters the adjacent second lower wall 223 adjacent to the direction-correcting upper slot 22 and the tail 32 of the bullet 3 passes the first lower wall 222 adjacent to the direction-correcting upper slot 22 (refer to FIG. 6), the bullet 3 will be affected by the gravity of the bullet 3 tail 32, so that the bullet 3 will fall down into the direction-correcting guide slot 23 with the tail 32 facing down and then be guided out along the one-way export slot 24. Therefore, the bullets 3 derived from the aforementioned track 2 by the heavier gravity action of the bullet 3 tail 32 are in the same direction, which can be conveniently used with a bullet filling device (not shown) or an electronic magazine loader (not shown) to fill bullets 3 into the magazine (not shown).

Figure 4:
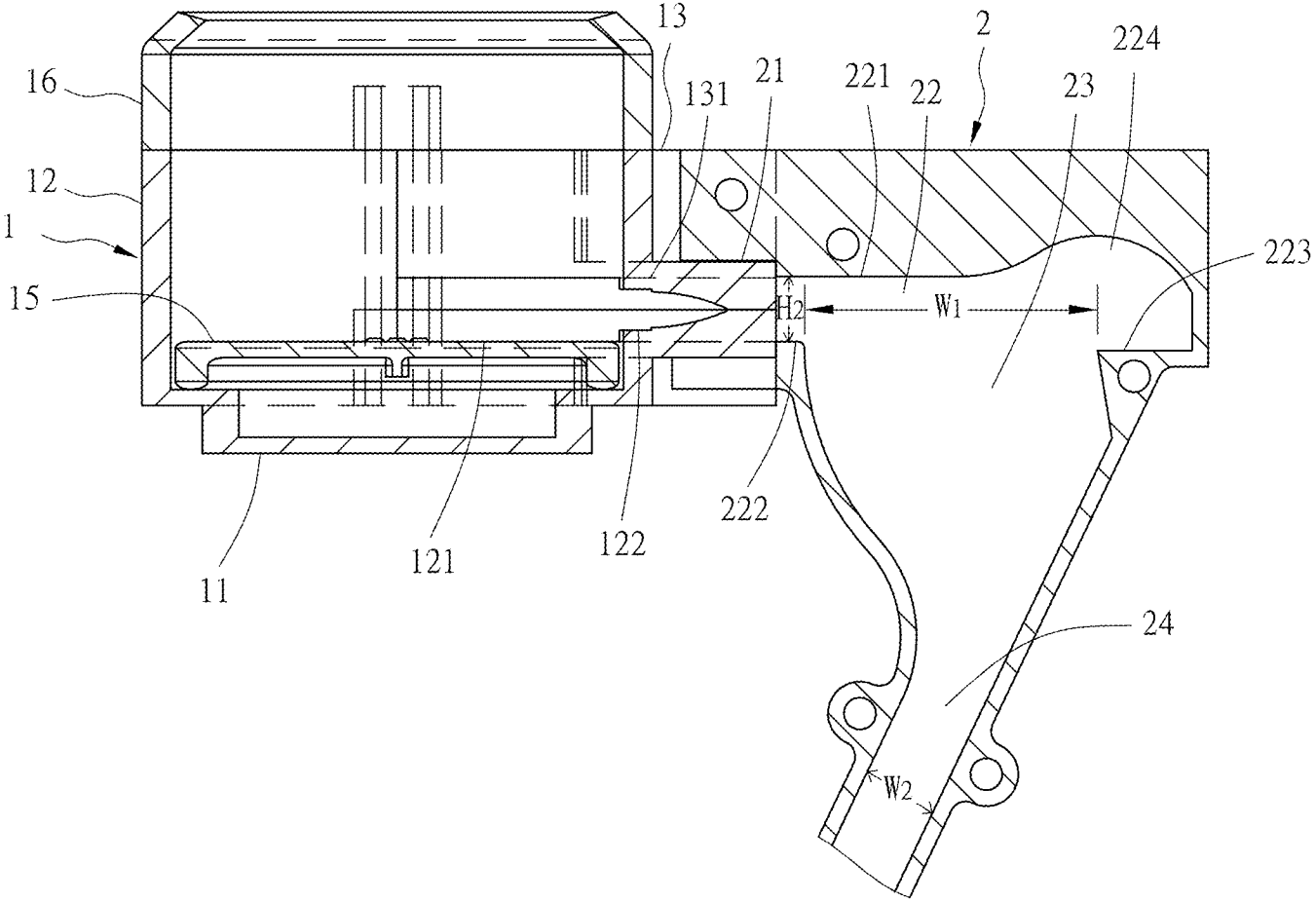
FIG. 4 is a sectional view taken along line A-A of FIG. 3.
Figure 5:
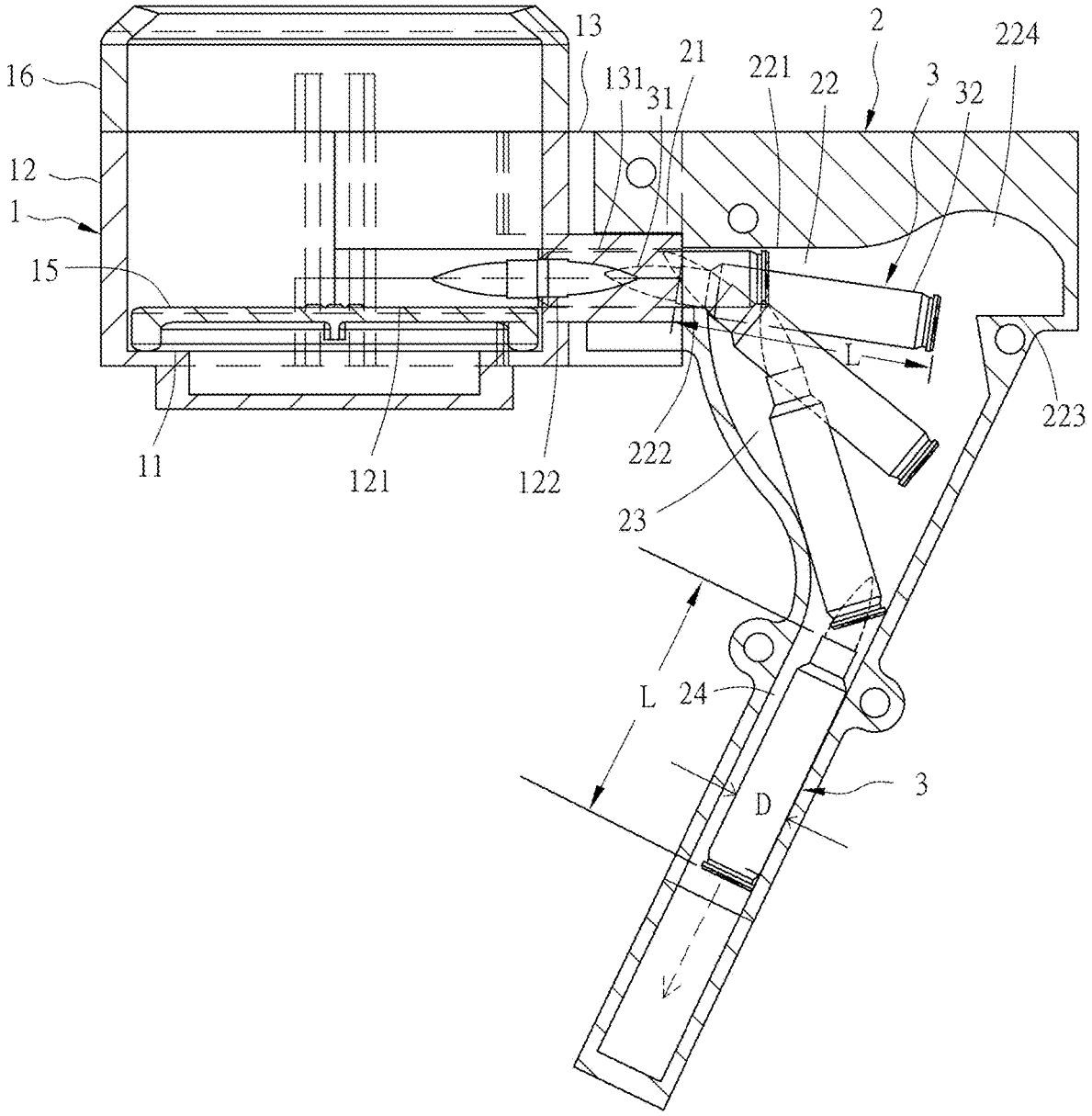
FIG. 5 is a schematic drawing of the present invention, showing the tail of the bullet passed the first lower wall adjacent to the direction-correcting upper slot and the direction of the bullet corrected.
Figure 6:
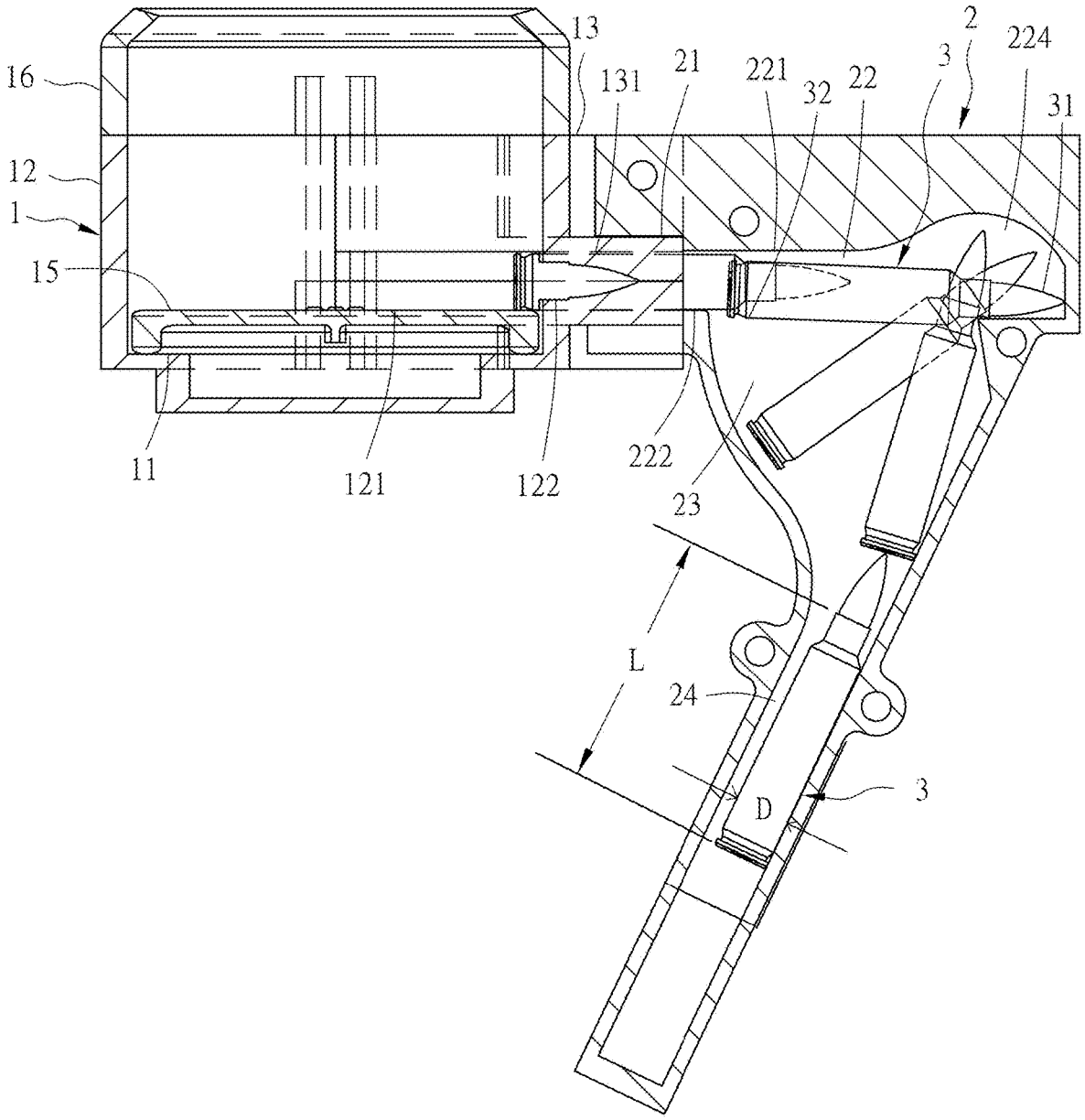
FIG. 6 is a schematic drawing of the present invention, showing the head of the bullet passed the first lower wall adjacent to the direction-correcting upper slot and the direction of the bullet corrected.
Figure 7:
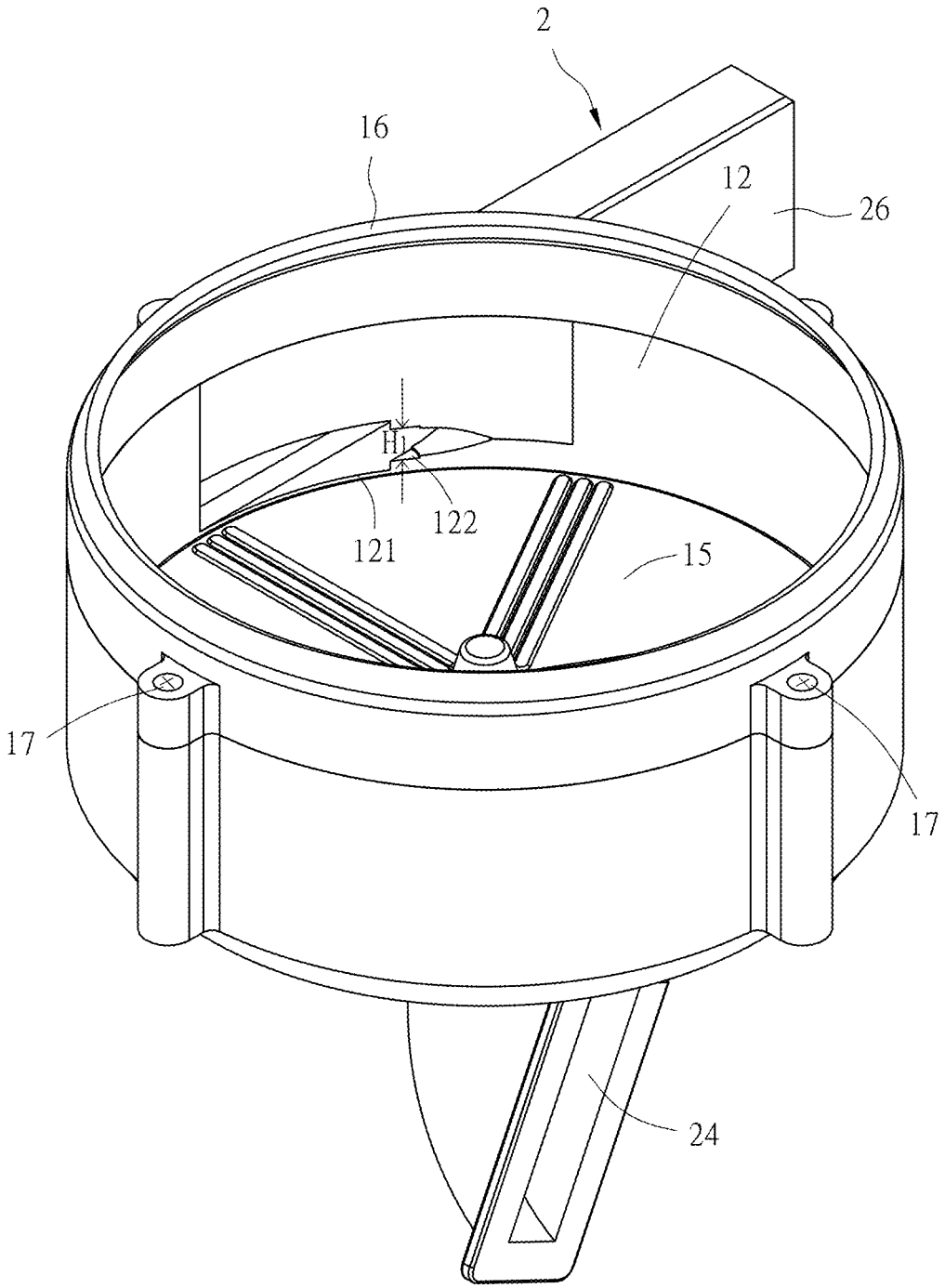
FIG. 7 is another top elevational view, in an enlarged scale of the bullet aligning device in accordance with the present invention.

Furthermore, the direction-correcting upper slot 22 of the aforementioned track 2 forms an enlarged space portion 224 above the rear side (refer to FIG. 4 to FIG. 6). The enlarged space portion 224 is used to provide an ample space for the bullet 31 to swing the head 31 upward (refer to FIG. 6) when the tail 32 of the bullet 3 passes through the first lower wall 222 adjacent to the direction-correcting upper slot 22 and the tail 32 of the bullet 3 is affected by gravity to fall downward into the direction-correcting guide slot 23.

In conclusion, the present invention can be summarized to have the following effects:

1. The through groove 122 is formed on the circumferential wall 12 of the turntable holder 1 adjacent to one end of the bullet outlet 121, and the height H1 of the through groove 122 is smaller than the diameter D of the bullet 3 to prevent the heads 31 of two or more bullets 3 from jamming the bullet outlet 121, thereby ensuring the smooth delivery of bullets 3.

2. No matter whether the head 31 of the bullet 3 or the tail 32 of the bullet 3 enters track 2 first, as long as the bullet 3 enters the track 2, the heavier gravity of the tail 32 of the bullet 3 can make the bullet 3 choose the heavier tail 32 to fall into the direction-correcting guide slot 23, and bullets 3 are guided out by the one-way export slot 24 in the same direction to facilitate the filling of bullets 3 into the magazine with the bullet filling device or the electronic magazine loader.

What is claimed is:

1. A bullet aligning device, comprising:

a turntable holder comprising a bottom wall, a circumferential wall connected above said bottom wall, a connecting portion externally connected to said circumferential wall and a mounting groove located on said bottom wall for setting a motor to directly or indirectly drive a turntable to rotate, said circumferential wall being provided with a bullet outlet and a through groove in communication with one end said bullet outlet, said connecting portion being provided with a linear guide channel in communication with said bullet outlet, the highest height of said through groove being slightly smaller than the diameter of a bullet to be aligned so that when said turntable rotates, the bullets poured into said turntable are thrown to the periphery of said turntable through centrifugal force and enter said linear guide channel of said connecting portion through said bullet outlet of said circumferential wall, said connecting portion being also provided with a plug hole and at least a connecting hole; and a track connected to said circumferential wall of said turntable holder, said track comprising an insert block located at one side thereof and plugged into said plug hole of the turntable holder, an entrance, a direction-correcting upper slot, a direction-correcting guide slot and a one-way export slot, said entrance having one end thereof connected to said linear guide channel of said connecting portion of said turntable holder and an opposite end thereof connected to said direction-correcting upper slot, said direction-correcting upper slot having an upper side thereof disposed adjacent to an upper wall and front and rear ends of an opposing lower side thereof respectively disposed adjacent to a first lower wall and a second lower wall, the width distance between said first lower wall and said second lower wall being less than the length of a bullet case of said bullet, the height distance between said first lower wall and said upper wall being slightly larger than the diameter of said bullet and only for said bullet to pass transversely, the lower side of said direction-correcting upper slot communicating with an upper side of said direction-correcting guide slot, said direction-correcting guide slot being narrowed from the upper side to a lower side thereof and then connected to an upper end of said one-way export slot, the slot width of said one-way export slot being slightly larger than the diameter of said bullet to restrict said bullet to only one-way export from said one-way export slot, said track being also connected with a track cover.

2. The bullet aligning device as claimed in claim 1, wherein said direction-correcting upper slot of said track forms an enlarged space portion above the rear side thereof, said enlarged space portion being used to provide an ample space for said bullet to swing the head upward when the tail of said bullet passes through said first lower wall adjacent to said direction-correcting upper slot and the tail of said bullet is affected by gravity to fall downward into said direction-correcting guide slot.

* * * * *